United States Patent [19]

Beach

[11] 4,262,188

[45] Apr. 14, 1981

[54] METHOD AND APPARATUS FOR IMPROVING PRINT QUALITY OF A THERMAL PRINTER

[75] Inventor: Harold E. Beach, Escondido, Calif.

[73] Assignee: Hewlett-Packard Company, Palo Alto, Calif.

[21] Appl. No.: 43

[22] Filed: Jan. 2, 1979

[51] Int. Cl.[3] ..... H05B 1/00

[52] U.S. Cl. ..... 219/216; 346/76 PH

[58] Field of Search ..... 219/216; 355/3 FU; 346/76 PH

[56] References Cited

U.S. PATENT DOCUMENTS

| | | | |
|---|---|---|---|
| 3,577,137 | 5/1971 | Brennan, Jr. | 219/216 X |
| 3,745,304 | 7/1973 | Hutner | 219/216 |
| 3,916,256 | 10/1975 | Kotani | 219/216 X |

*Primary Examiner*—C. L. Albritton

*Attorney, Agent, or Firm*—Allston L. Jones; Edward Y. Wong

[57] ABSTRACT

The uniformity of density of characters printed by thermal printers upon thermally sensitive paper is enhanced by controlling the amount of energy supplied to the print head during subsequent printings before the print head has completely cooled to ambient temperature. To obtain the desired uniformity the energy supplied to the print head for subsequent printings is made proportional to the energy lost by cooling of the print head between printings. This results in the print head being reheated to substantially the same printing temperature for each printing of a character or character segment.

By using a dot driver having an R-C circuit that recharges the capacitor between print pulses at a rate that is proportional to the thermal time constant of the print head, the energy stored by the capacitor can then be used to re-heat, or control the re-heating, of the print head to substantially the same selected print temperature. By maintaining the R-C charging time constant substantially between $0.1\tau$ and $\tau$ ($\tau$ is the thermal time constant of the print head) the resultant printed character segments have substantially uniform density.

4 Claims, 8 Drawing Figures

METHOD AND APPARATUS FOR IMPROVING PRINT QUALITY OF A THERMAL PRINTER

BACKGROUND OF THE INVENTION

Generally, to produce a uniform trace when plotting a line segment of printing an alphanumeric character, prior art thermal printers and plotters often included circuitry which provided uniformity of trace as a function of such factors as battery voltage level or slew rate of the print-plot head. Thermal printer-plotters of this type are described, for example, in U.S. Pat. No. 3,934,695, entitled "Method and Apparatus for Enhancing and Maintaining Character Quality in Thermal Printers," issued Jan. 27, 1976 to Albert W. Kovalick, and in U.S. Pat. No. 3,986,011 entitled "Printer-Plotter System," issued Oct. 12, 1976 to John S. Poole, et al.

In thermal printers where the print rate is on the order of 10 characters per second or less (e.g., 5 milliseconds power on pulse with a minimum period of 35 milliseconds), the above techniques for producing uniform characters are generally sufficient. However, when the same thermal printers are used at a faster printing rate (i.e., shorter period), the individual thermal elements in the character matrix produce printed images of varying density resulting in character images that are hard to read.

The underlying cause of these problems is that the same amount of power is typically applied to each thermal element each time it is actuated independent of the residual temperature of the print head at the time of actuation. Thus, a previously energized thermal element (e.g., an element energized to print a previous line segment or alphanumeric character) may cool to a temperature level that is higher than the ambient temperature level of an element not previously energized, or to ambient temperature if it has had sufficient time to fully cool. Hence, the previously energized thermal element, that has not cooled completely will heat to a higher temperature than the not previously energized thermal element, when it is activated, resulting in the printing of a higher density image. If the thermal elements are continually reactivated at the faster print rate, the printing temperature will become increasingly greater until it reaches a new steady-state with the inherent danger that the thermal element may become overheated causing its failure.

To overcome these problems, a thermal element drive circuit is needed wherein the amount of power applied to the thermal element is proportional to the amount of power necessary to reheat the thermal element to substantially the desired printing temperature. The instant invention provides such a solution.

SUMMARY OF THE INVENTION

The present invention provides a method and apparatus for metering the amount of energy transferred to a thermal element of a thermal print head for each printing of a character segment to provide characters, each segment of which is substantially uniform in density as printed on a selected printing medium.

Each of the preferred embodiments of this invention include a gating element that is responsive to a print pulse generated by an external character generator and timing circuit for causing printing of the selected character element at the proper time. The gating element is next coupled to an energy storage means having an energy storage rate that is directly proportional to the rate that the print head loses thermal energy. Thus, when the gating means is unenergized the energy storage means is storing energy for the next printing, and when the gating means is energized the energy means is transferring energy to, or controlling the energy transfer to, the thermal elements on the print head so that each time a character segment is to be printed the print head is reheated to substantially the same printing temperature as for each previous printing.

DESCRIPTION OF THE PREFERRED EMBODIMENT

The print heads of typical thermal printers have a number of thermal elements, or dots, typically seven, arranged in a column or other convenient configuration. The print head is mounted in close proximity to the surface of a selected thermally sensitive paper. Printing is accomplished by selectively applying power to the thermal elements, which are electrically resistive, causing the print head to increase in temperature in the vicinity of the thermal element and radiating some of that heat to the paper to record an image of that thermal element thereon. There is also a motor to advance the paper or the print head a selected distance, one relative to the other to permit the continuation of the printing process. In the typical arrangemnt it is the print head which is moved while the paper remains stationary, with each character being formed from a series of dots.

Figure 1:
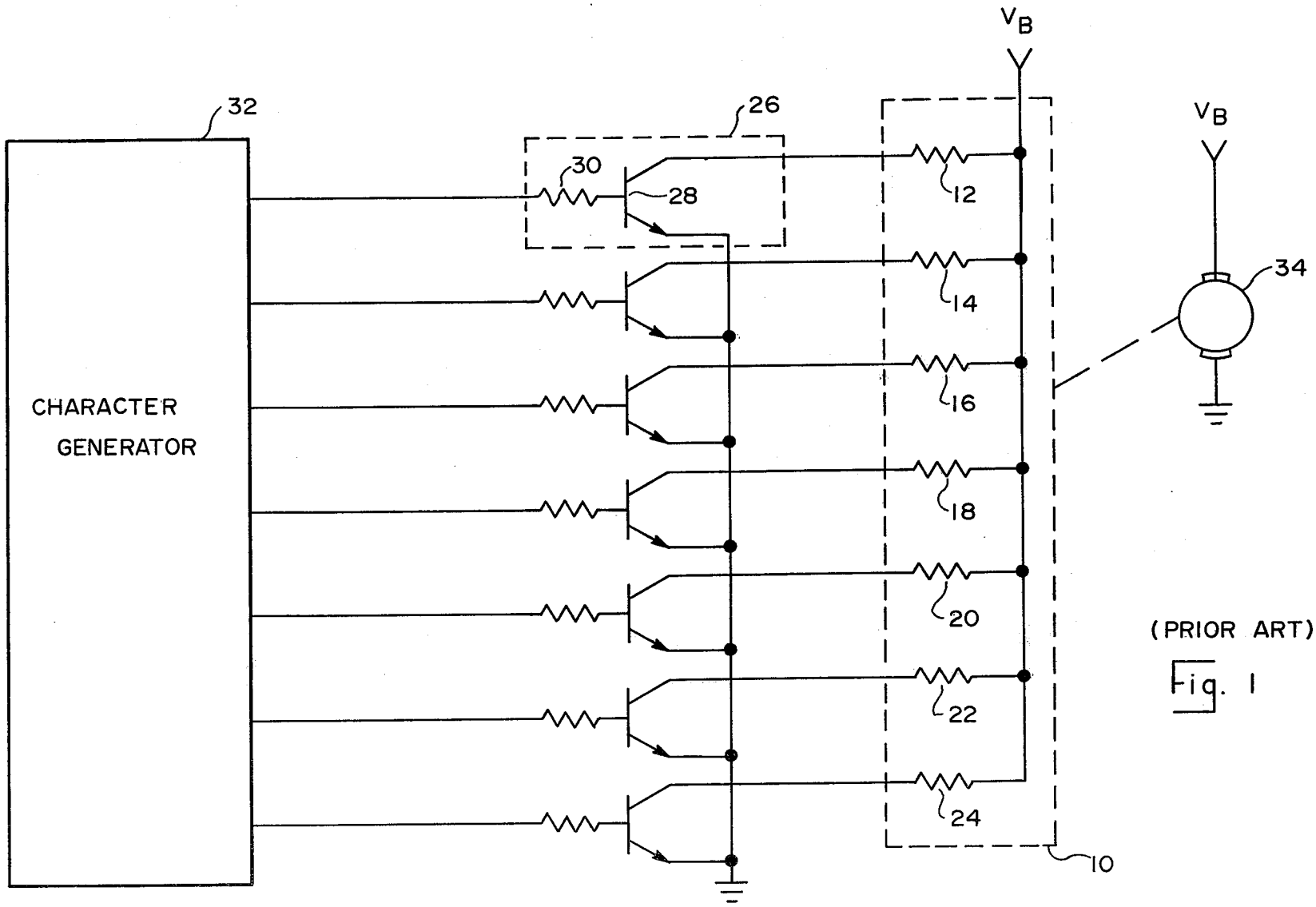
(PRIOR ART) Fig. 1
FIG. 1 is a schematic representation of a typical prior art thermal printer print actuation means.

The circuit shown in FIG. 1 is representative of circuit configuration of the prior art thermal printers. Shown in this figure are a thermal print head 10 having thermal elements 12 through 24 (shown as resistors) mounted thereon. One end of each of thermal elements 12 through 24 is connected to the voltage bus $V_B$. The other end of each of the thermal elements 12 through 24 is connected individually to a separate thermal element or dot driver to permit selective actuation of the respective thermal element. Dot driver 26 is representative of each of the dot drivers and is comprised of a transistor 28 and a resistor 30. Transistor 28 is connected in a common emitter configuration with its emitter connected to ground, its collector coupled to $V_B$ through thermal element 12 and its base connected to one end of resistor 30 for input current limiting. The second end of resistor 30 is connected to character generator 32 which digitally generates the necessary pulses to the input lines of selected dot drivers to cause the printing of a selected character or a portion of that character.

In a typical thermal printer, the print pulse from character generator 32 is a 5 ms digital pulse which is applied to the base of transistor 28 via resistor 30. Transistor 28 is biased such that when the input print pulse is applied to its base it turns on (i.e., saturates) allowing current to flow through thermal element 12. The current through thermal element 12 causes it to heat up and produce a printed image on the paper adjacent to thermal element 12. After the first portion of the character is printed, motor 34 is activated to advance print head 10 to the next print location.

Figure 2:
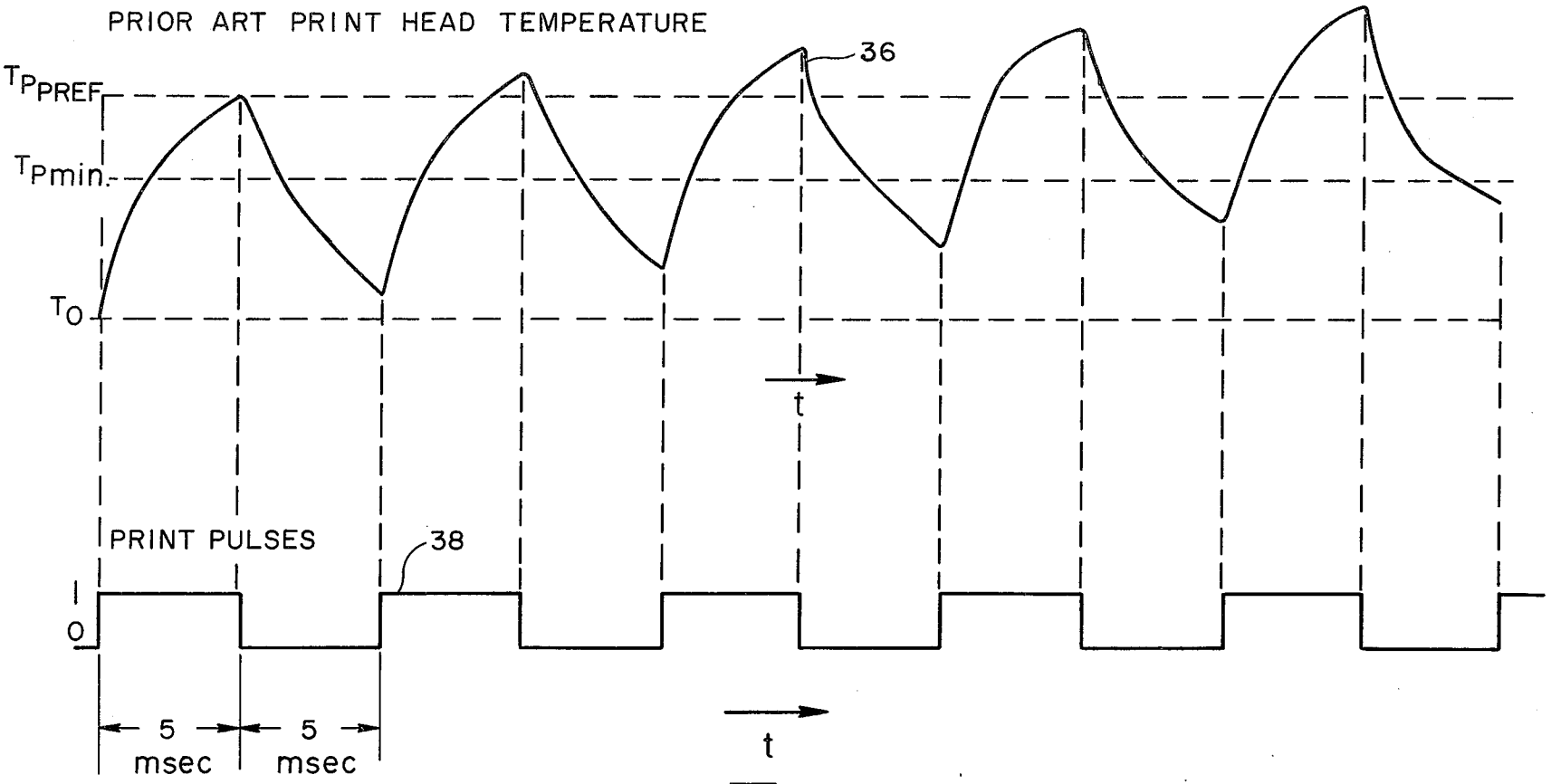
FIG. 2 is a graphical illustration of the print head temperature when the circuit of FIG. 1 is utilized to power the thermal print elements at a duty cycle which does not permit sufficient cooling of the print head between printings.

A typical thermal print head has a thermal time constant that is substantially equal to 5 ms (e.g., HP91 print head). Thus, when a print rate of less than 20 ms is utilized, the print head will have substantial residual heat when the thermal print element is reactivated. In FIG. 2, the variations in the print head temperature are plotted with respect to time (plot 36) for a series of printing pulses wherein the print rate is 10 msec with each print pulse being 5 msec in length (plot 38). In FIG. 2, $T_O$ represents the ambient room termperature, $T_{Pmin}$ represents the minimum printing temperature of the print head, $T_{Ppref}$ represents the preferred printing temperature of the print head. When dot driver 26 of FIG. 1 is utilized to activate its respective thermal element, the same amount of power is applied thereto irrespective of when it was last activated. This fact, coupled with the time between print pulses being less than three times the thermal time constant of the print head, results in an increase in the peak temperature level of the print head in response to the second print pulse as shown in FIG. 2.

Figure 3:
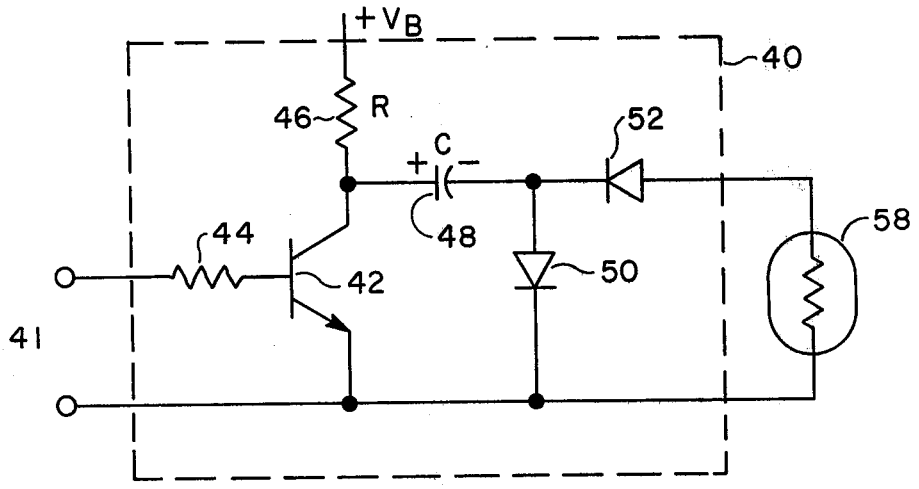
FIG. 3 is a schematic diagram of a thermal element actuation circuit constructed according to one embodiment of the present invention.

A circuit representative of the first embodiment of a dot driver 40 of the present invention is shown in FIG. 3. Dot driver 40 in this configuration includes a transistor 42 connected in the common emitter configuration with a series base resistor 44 connected between the base of transistor 42 and one of the input terminals 41. The second input terminal 41 is the common line or ground of the circuit with the input signals being supplied by a character generator (not shown). In addition, the collector of transistor 42 is connected to the voltage bus, $V_B$, via a resistor 46, having a value of R. One end of capacitor 48, having a value of C, is also connected to the collector of transistor 42, and the other end of capacitor 48 is connected to the anode of the shunt diode 50 and the cathode of series diode 52. The cathode of shunt diode 50 is in turn connected to the common line. Thermal element 58 is connected between the anode of series diode 52 and the common line.

In the quiescent state, transistor 42 is nonconductive and capacitor 48 charges toward $V_B$ through resistor 46 and shunt diode 50. During the charging period of capacitor 48, the current through thermal element 58 is limited to the leakage current through back biased series diode 52. It should be noted at this point that series diode 52 can be eliminated if the voltage drop across shunt diode 50 is sufficiently low so that the corresponding current through thermal element 58 is insufficient to cause an unwanted image to appear on the thermal paper (not shown) adjacent to thermal element 58. In most situations the voltage drop across shunt diode 50 (e.g., 0.6 v) is sufficiently low so that there will be no spurious printing on the thermal paper.

When a print pulse is applied to input terminals 41 of dot driver 40, transistor 42 is driven into saturation by virtue of the biasing effect of the value of resistor 46. While the print pulse is present, capacitor 48 is effectively connected in series with thermal element 58 and series diode 52 with series diode 52 forward biased and shunt diode 50 reverse biased by the polarity of the charge on capacitor 48, resulting in the heating of thermal element 58 to the selected printing temperature. Upon the removal of the print pulse from dot driver 40, it reverts to charging capacitor 48.

Figure 4A:
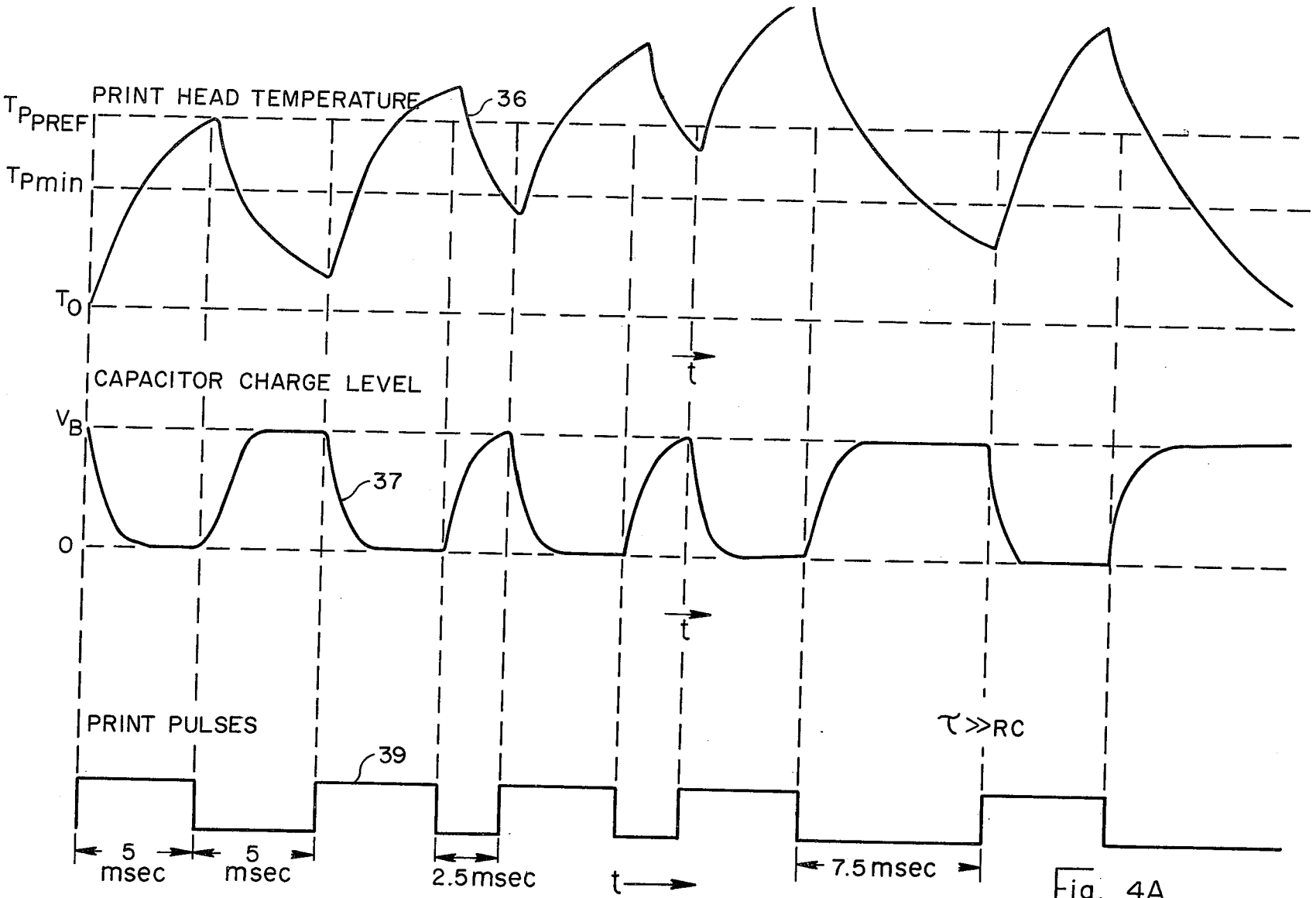
FIGS. 4*a, b,* and *c* are graphical illustrations of the print head temperature when the circuit of FIG. 3 is utilized to power the thermal print elements when the capacitor is fully recharged in proportion to the heat lost by the print head respectively between printings.

FIGS. 4*a, b* and *c* illustrate the interrelationship between the thermal time constant, $\tau$, of the thermal print head and the charging time constant, RC, of capacitor 48 and registor 46 (FIG. 3). Each of these graphical illustrations show the variations of the print head temperature (plot 36) and the charge level on capacitor 48 (plot 37) in response to a series of print pulses (plot 39) for various RC time constants. In each of these figures, $T_O$ represents the ambient room temperature $T_{Pmin}$ represents the minimum printing temperature of the print head $T_{Ppref}$ represents the preferred printing temperature of the print head $V_B$ represents the bus voltage of FIG. 3.

Also in each of FIG. 4*a, b* and *c*, the individual printing pulses (plot 39) have been selected to be 5 msec wide, the typical thermal time constant of known thermal print heads.

For a charging time constant RC, of capacitor 48 that is much shorter than the thermal time constant of the print head, the interrelationship of the variations in print head temperature (plot 36) and capacitor charge (plot 37) for a selected series of input print pulses (plot 39) to a circuit like that shown in FIG. 3 can be seen in FIG. 4*a*. From this figure it can be seen that capacitor 48 fully recharges following each print pulse, even when the interval between print pulses is only one-half the thermal time constant of the print head. Thus, the same problem as with the prior art dot drivers is present, i.e., the same amount of energy (plot 37) is transferred to thermal element 58 with each activation resulting in the uneven heating of the thermal print head (plot 36).

A similar situation results if RC is selected to be much longer than the thermal time constant of the print head. FIG. 4*c* shows the interrelationship of the same functions with the same series of print pulses applied to dot driver 40 (FIG. 3). However, in this situation capacitor 48 does not recharge (plot 37) between print pulses sufficiently to supply enough energy to thermal element 58 to maintain the print head at the preferred printing temperature (plot 36) except at a much slower print rate than that represented by the series of print pulses in this figure.

Figure 4B:
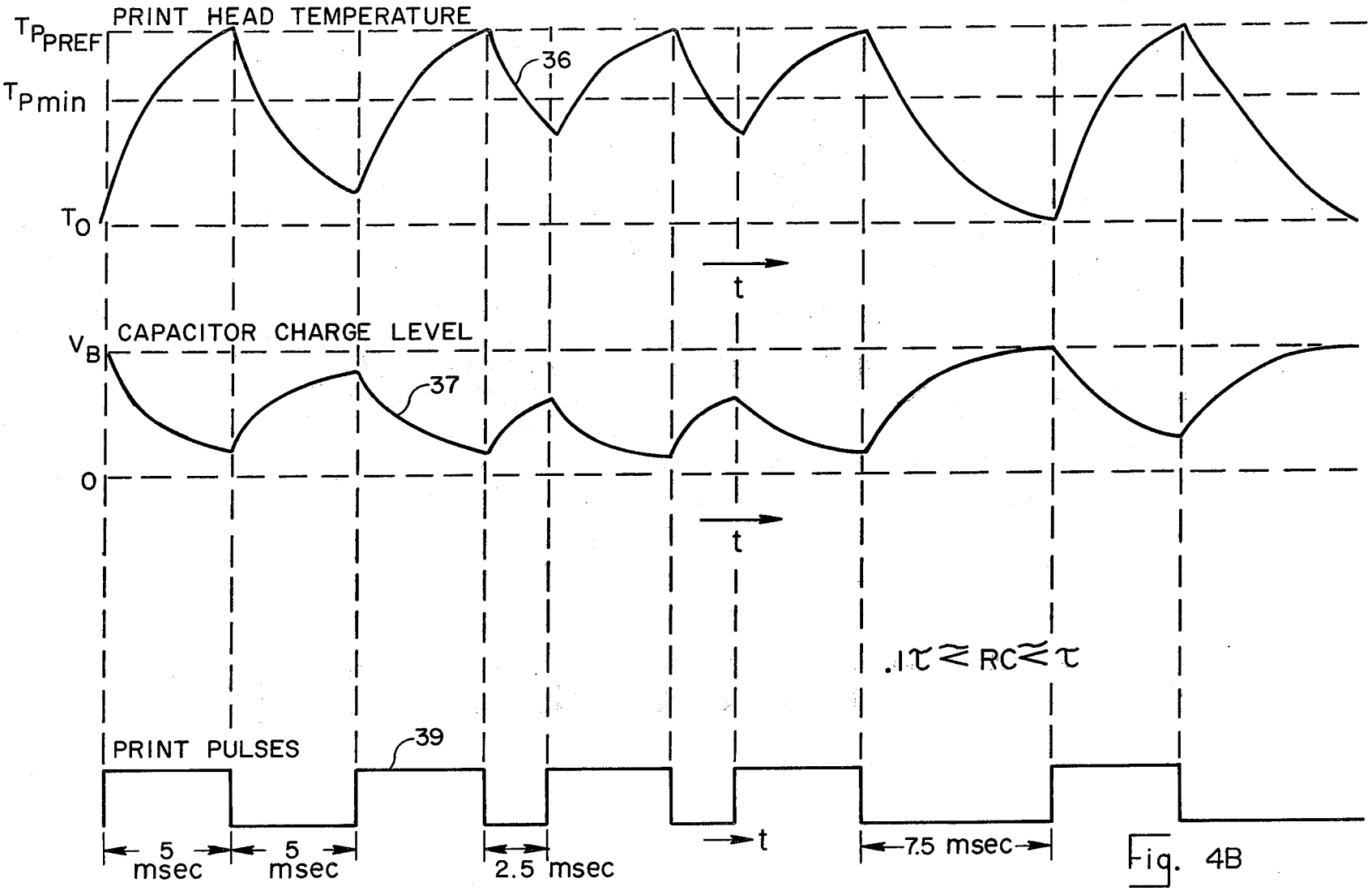
Figure 4C:
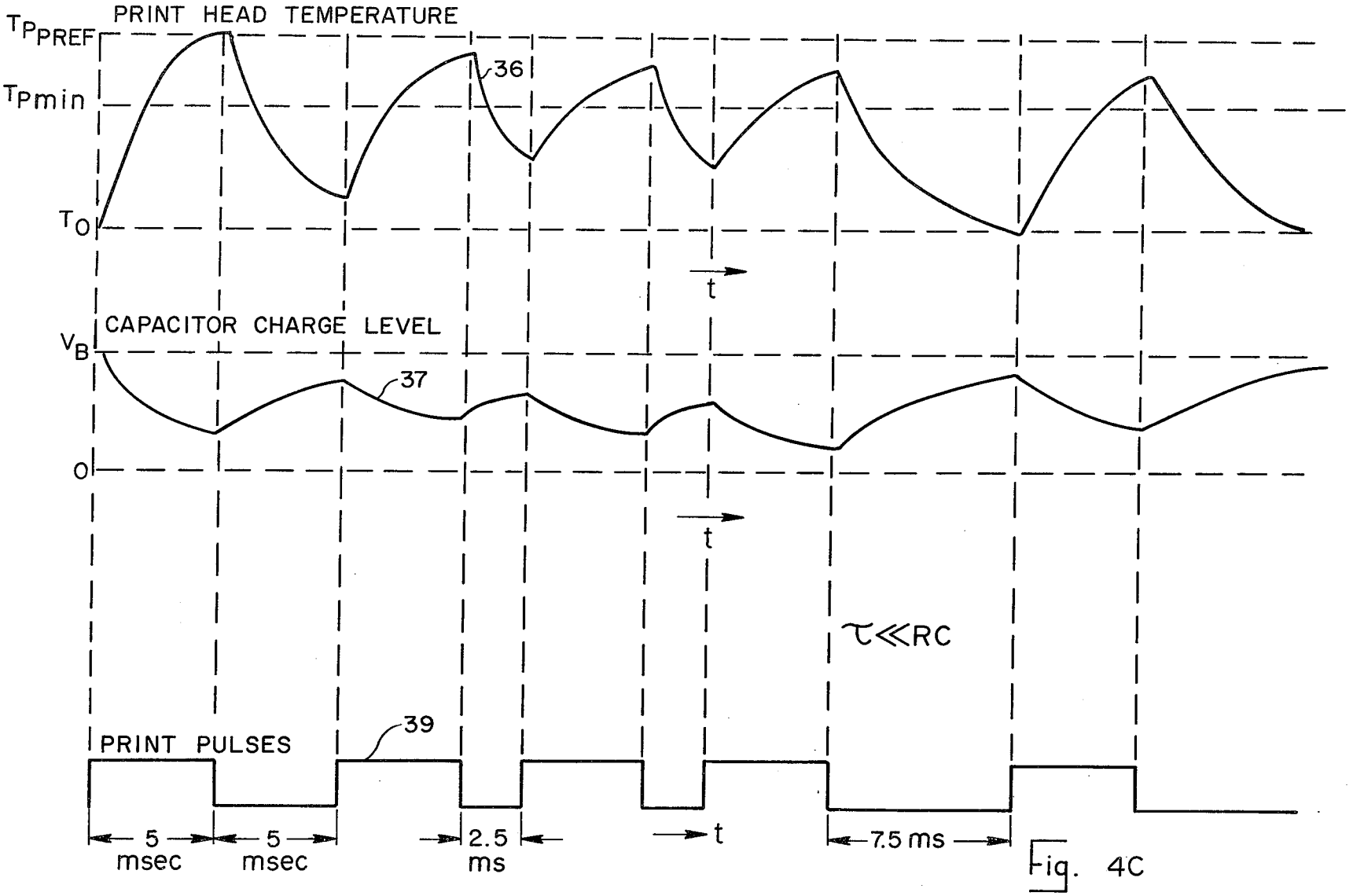

The third figure in this series, FIG. 4*b*, shows the same interrelationship of the functions as in the other two figures with RC selected to be in the approximate range of 0.1 $\tau$ to $\tau$. As can be seen from the figure, capacitor 48 recharges (plot 37) sufficiently between print pulses to deliver a sufficient amount of energy to thermal element 58 during the next print pulse to substantially reheat the print head to the preferred printing temperature (plot 36) for each print pulse (plot 39).

Figure 5:
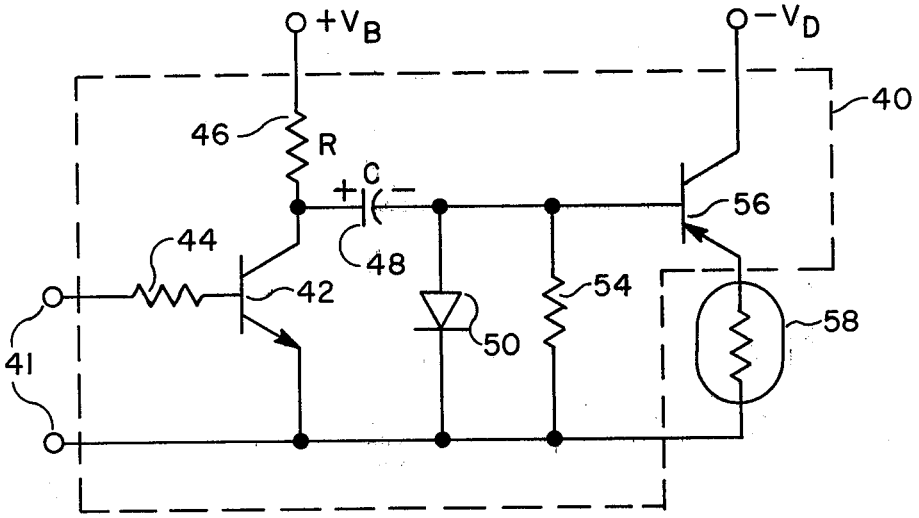
FIG. 5 is a schematic diagram of a second embodiment of the present invention.
Figure 6:
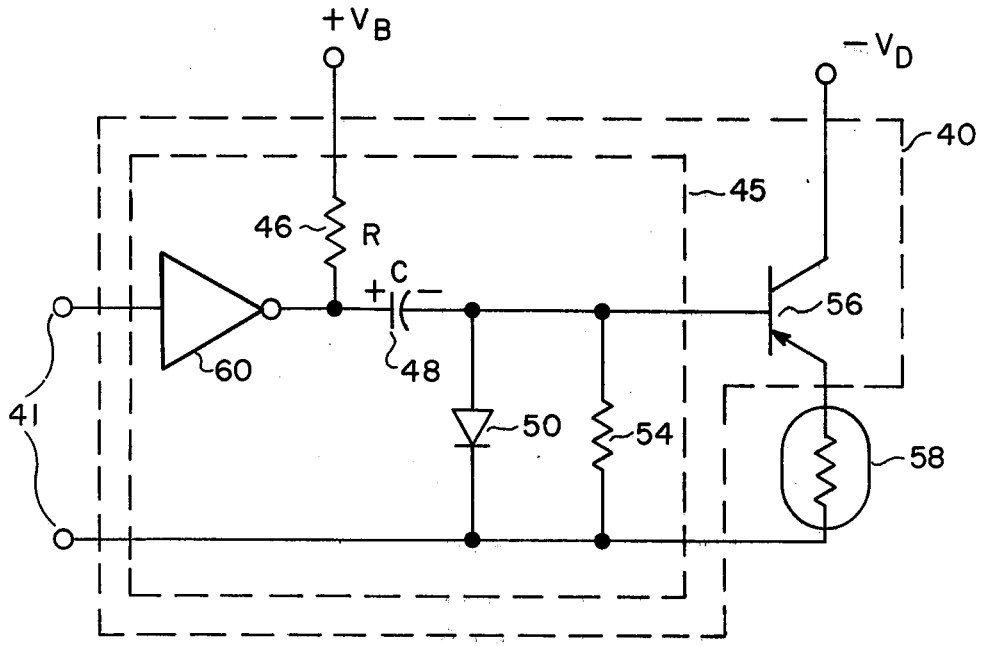
FIG. 6 is a schematic diagram of a third embodiment of the present invention.

FIGS. 5 and 6 show two other embodiments of the dot driver 40. In each of these configurations, series diode 52 (FIG. 3) has been replaced by transistor 56. Transistor 56 is a complementary type of transistor to transistor 42 and is connected in a common collector configuration with thermal element 58 being the emitter load resistance. In addition, the collector of transistor 56 is connected to the $-V_D$ bus line and its base is connected to the anode of diode 50. Dummy load resistor 54 has also been added between the base of transistor 56 and the common return line. FIG. 6 has additionally been modified by replacing transistor 42 with a standard logic element which has an open collector output stage.

The circuits of FIGS. 5 and 6, as a result of the common collector output stage, each offer a circuit wherein the print current through thermal element 58 varies only as the RC time constant of dummy load resistor 54 and capacitor 48 since the energy available to cause printing is not directly limited to that which is stored on capacitor 48. This provides the added advantage of being able to use a capacitor 48 of a smaller physical size. In these configurations, the voltage level on capacitor 48 need only be sufficient to maintain transistor 56 in an active state for a long enough period to permit thermal element 58 to reach the preferred printing temperature; the energy for printing is provided by the $-V_D$ bus.

Each of the circuits shown in FIGS. 3, 8, 5 and 6 can be used with either of the two types of print head configurations, i.e., where one end of each thermal element is brought out individually while the second end of each is connected together and brought out as a single line, and those where both ends of each thermal element are brought out individually.

Figure 7:
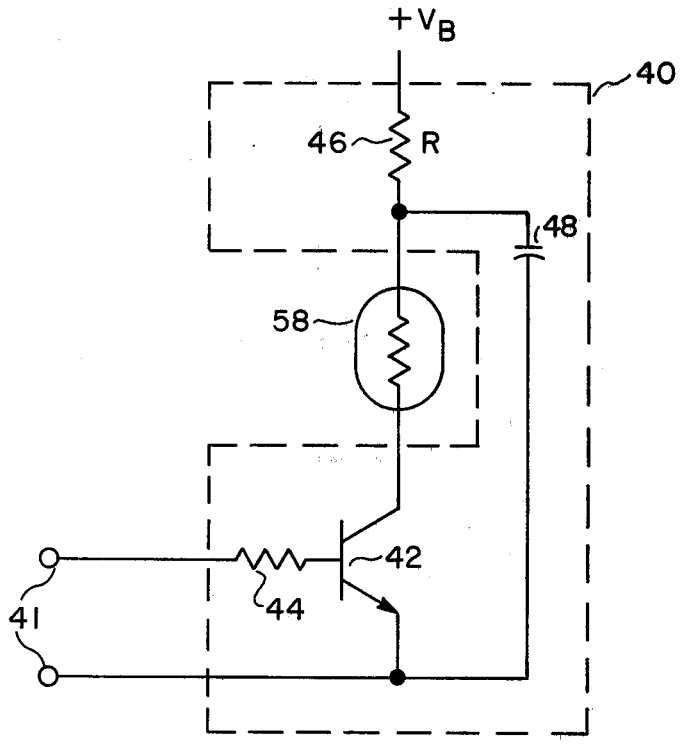
FIG. 7 is a schematic diagram of a fourth embodiment of the present invention.

FIG. 7 shows a fourth embodiment that can only be used with the thermal print heads of the second configuration, i.e., those where both ends of each thermal element are brought out individually. Dot driver 40 of this figure is similar to that of FIG. 3 with diodes 50 and 52 removed, the negative end of capacitor 48 connected to the common line, and thermal element 58 relocated to be serially connected between the collector of transistor 42 and the junction of resistor 46 and capacitor 48. This circuit operates in a manner that is very similar to those discussed above.

Figure 8:
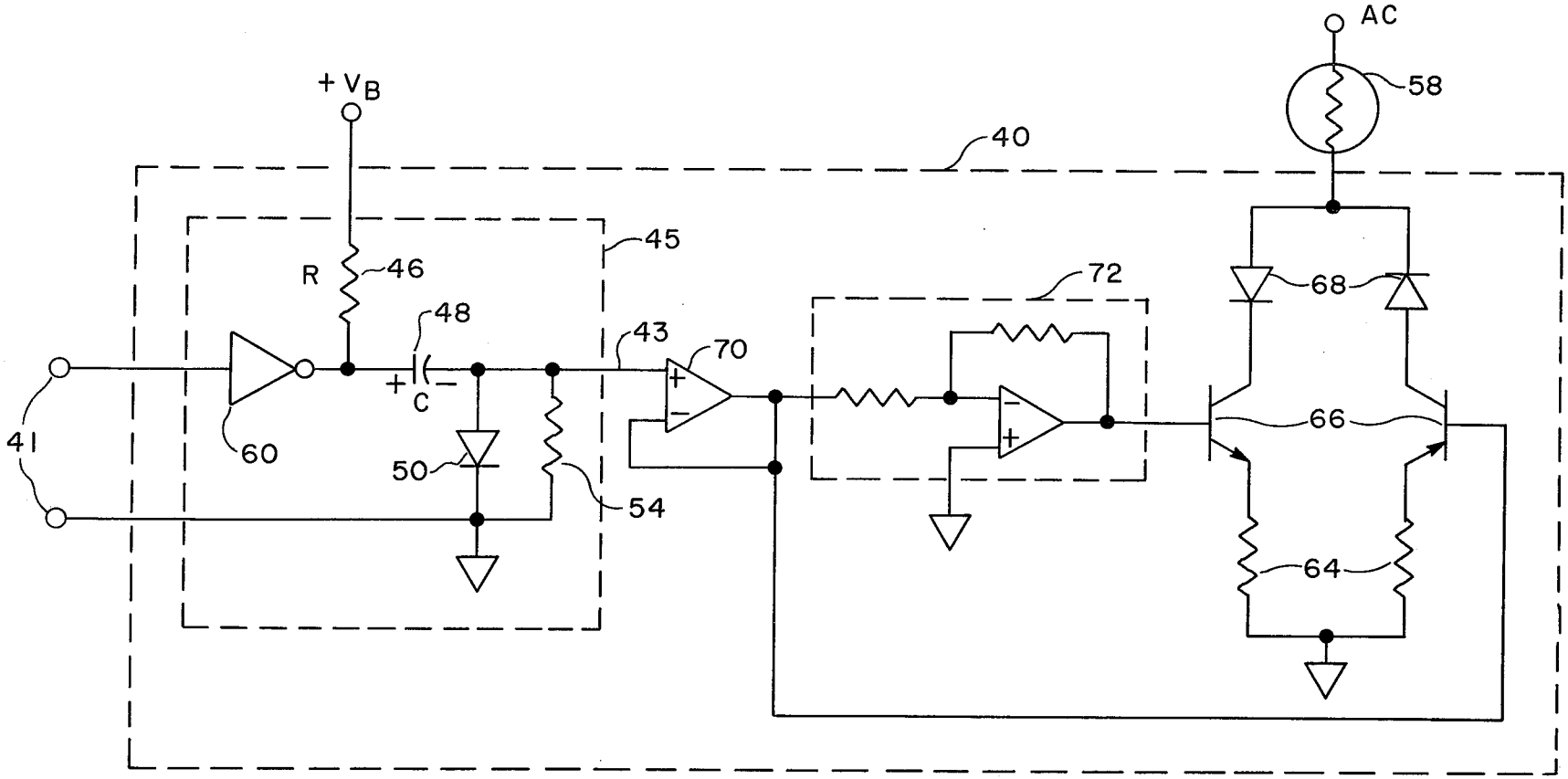
FIG. 8 is a schematic diagram of a fifth embodiment of the present invention.

In FIG. 8 there is shown a dot driver 40 for a system where thermal element 58 is powered by an A.C. signal. The source of this signal, for example, might be a high frequency switcher power supply. This embodiment comprises a basic dot driver 45 similar to the one in FIG. 6. Output line 43 of basic dot driver 45 is connected to the summing input of operational amplifier 70 (op amp 70). In addition, the subtracting input and the output of op amp 70 are connected one to the other. The function of op amp 70 is to buffer the negative going control signal from capacitor 48 as it discharges when a print pulse is present on input lines 41. The output of op amp 70 is also coupled to the negative input of op amp 72. Op amp 72 has its positive input connected to the common line and this op amp functions as an inverter.

This circuit also includes a pair of complementary transistors 66 each having one of a pair of emitter resistors 64 to the common line to form a constant current driver stage. Additionally, the collector of each of transistors 66 is connected in series with one of the pair of diodes 68 to block reverse current flow through transistors 66. The outputs of op amps 70 and 72 are connected to the base of the NPN- and the PNP- transistor of transistor pair 66, respectively. The free end of each of diodes 68 are connected together and in turn are connected to one end of thermal element 58. The other end of thermal element 58 is connected to an A.C. source.

When a print pulse is applied to input terminals 41, op amps 70 and 72 forward bias their respective transistor of transistor pair 66. A.C. current is then free to flow through thermal element 58, causing it to heat up, and alternately through the two branches of the constant current stage under the control of diodes 68. As in the above discussed embodiments, the length of time, or amount of power allowed to flow through thermal element 58 is controlled by the proper selection of the RC time constant to produce a print head temperature response as that shown in FIG. 4*b*.

I claim:

1. Method for printing characters with an electrothermal transducer type print head, having at least one thermal element, on a thermally sensitive medium, the method comprising, in the order recited, the steps of:

charging an energy storage means to a preselected level;

electrically energizing a thermal element of said print head from said energy storage means to cause heating of said thermal element to a selected temperature to print a selected character segment of a selected density on the thermally sensitive medium;

recharging said energy storage means at a fixed preselected rate that is proportional to the thermal energy loss rate of the print head;

subsequently energizing a thermal element of said print head from said energy storage means to reheat the print head to substantially the same selected temperature to print another character segment of substantially the same selected density as that of previously printed character segments on the thermally sensitive medium; and repeating the recharging and subsequently energizing steps a sufficient number of times to complete the desired printing.

2. Apparatus for printing characters with an electrothermal transducer type print head, having at least one thermal element, on a thermally sensitive printing medium, the apparatus comprising:

gating means responsive to an applied print pulse for initiation of the printing of selected character segments; and energy storage means coupled to the gating means and at least one thermal element on the print head for storing electrical energy, said energy storage means having a fixed preselected time constant that is proportional to the thermal energy loss time constant of the print head when printing is not being performed, and for limiting the amount of energy transferred to said at least one thermal element to an amount that is proportional to the amount of thermal energy lost by the print head between consecutive printings to reheat the print head to substantially the same selected temperature as during each prior printing to cause each character segment printed on the thermally sensitive medium to have substantially the same density as previously printed character segments.

3. An apparatus as in claim 2 wherein the preselected time constant of the energy storage means is equal to at least one-tenth the time constant of the thermal energy loss of the print head and no greater than the time constant of the thermal energy loss of the print head.

4. An apparatus as in claim 2 wherein said energy storage means includes:

a resistor having a value of R with one end connected to the gating means and the other end coupled to receive an applied voltage; and a capacitor having a value of C with one end coupled to the one end of the resistor and the other end coupled to the at least one thermal element;

the time constant of the energy storage means being substantially equal to the product of the values R and C.

* * * * *

UNITED STATES PATENT AND TRADEMARK OFFICE

CERTIFICATE OF CORRECTION

PATENT NO. : 4,262,188

DATED : April 14, 1981

INVENTOR(S) : Harold E. Beach

It is certified that error appears in the above-identified patent and that said Letters Patent are hereby corrected as shown below:

Column 4, line 17, delete "registor" and insert --resistor--

Signed and Sealed this

*Eighth* Day of *September 1981*

[SEAL]

*Attest:*

GERALD J. MOSSINGHOFF

*Attesting Officer* *Commissioner of Patents and Trademarks*